United States Patent [19]

Tillman et al.

[11] Patent Number: 5,031,266

[45] Date of Patent: Jul. 16, 1991

[54] VACUUM CLEANER WAND SEAL

[75] Inventors: Ennis L. Tillman, Danville, Ky.; Gregg A. Greulich, Fort Smith

[73] Assignee: Whirlpool Corporation, Benton Harbor, Mich.

[21] Appl. No.: 454,358

[22] Filed: Dec. 21, 1989

[51] Int. Cl.[5] ..... A47L 9/24

[52] U.S. Cl. ..... 15/327.2; 15/377; 15/410; 277/227; 285/319; 285/921; 403/329

[58] Field of Search ..... 15/377, 410, 327.2; 277/227; 285/304, 319, 320, 921; 403/329, 330

[56] References Cited

U.S. PATENT DOCUMENTS

| | | | |
|---|---|---|---|
| 2,064,397 | 12/1936 | White | 285/7 |
| 2,245,151 | 6/1941 | Martinet | 285/7 |
| 2,273,211 | 2/1942 | Martinet | 285/7 |
| 2,582,446 | 1/1952 | Martinet | 285/7 |
| 4,018,493 | 4/1977 | Lyman et al. | 339/15 |
| 4,331,351 | 5/1982 | Sobczyk | 285/7 |
| 4,349,206 | 9/1982 | Simm et al. | 277/207 |

FOREIGN PATENT DOCUMENTS

| | | | |
|---|---|---|---|
| 2138207 | 3/1972 | Fed. Rep. of Germany | 285/7 |
| 2037924 | 7/1980 | United Kingdom | 285/7 |
| 2053399 | 2/1981 | United Kingdom | 285/7 |

*Primary Examiner*—Chris K. Moore

*Attorney, Agent, or Firm*—Wood, Phillips, Mason, Recktenwald & VanSanten

[57] ABSTRACT

A wand seal assembly for a vacuum cleaner wand provides an improved seal between the telescopic connecting elements of the wand. The seal comprises a two-piece, dual durometer seal having a rigid portion with locking tabs for securing to the wand portion, and a flexible sealing portion.

19 Claims, 2 Drawing Sheets

VACUUM CLEANER WAND SEAL

FIELD OF THE INVENTION

This invention relates to vacuum cleaners and, more particularly, to a wand seal for a vacuum cleaner.

BACKGROUND OF THE INVENTION

Canister-type vacuum cleaners including a canister connected through a hose to a wand. The wand is in turn connected to a floor engaging nozzle. Often, a telescopic connection is provided between the hose and the wand. For example, the hose may include a handle portion providing a tubular male end received in an expanded female end of the wand. Also, the wand may comprise a two-piece wand wherein the two pieces are also telescopically connected, as above.

Since the hose and wand are used to provide suction between the canister and the nozzle, it is necessary that a sufficient seal be provided at the above-described tubular connections. Owing to the use of rigid materials, such as rigid plastic or metal, for the tubular connection elements, a proper seal can be difficult to attain. Further, such tubular connections can be somewhat loose which may tend to downgrade perceived quality.

In use, canister-type vacuum cleaners are occasionally operated without the floor engaging portion and wand. Instead, the end of the hose is used as the suction inlet, or one or both sections of the wand may also be used. The blunt metal or hard plastic end of the hose or wand can damage furniture and the like if used improperly.

The present invention is intended to overcome one or more of the problems discussed above, in a novel and simple manner.

SUMMARY OF THE INVENTION

In accordance with the invention, a resilient seal is provided between a male end of a first vacuum cleaner wand portion receivable in a female end of a second vacuum cleaner wand portion to improve the sealing therebetween.

In addition, the invention contemplates a resilient seal which provides a positive feel in the fitting between wand portions.

Broadly, there is disclosed herein a vacuum cleaner seal for a vacuum cleaner including a canister and a floor engaging portion coupled by a two-piece tubular suction element, one piece having a male end received in a female end of the other piece. The seal comprises a generally cylindrical tube inserted within the male end of the one piece and having an exterior flange to form a shoulder extending radially outwardly of the one piece to seal against the female end of the other piece, and means for securing the tube within the one piece.

According to one aspect of the invention, the tube is of two-piece construction. The first piece comprises a first cylindrical tube having a flange forming a first shoulder having an outer diameter substantially identical to an outer diameter of the male end. The second piece comprises a cylindrical tube secured within the first cylindrical tube and having a flange forming a second shoulder axially and radially outwardly of the first shoulder.

In one form the first piece is of rigid plastic construction.

In another form, the second piece is of flexible plastic construction.

According to another aspect of the invention, the second cylindrical tube includes a radial tab received in an interior groove in the first cylindrical tube.

According to a further aspect of the invention, the first and second shoulders are axially spaced to permit displacement of the second shoulder incident to insertion of the male end within the female end.

Specifically, there is disclosed herein a wand seal assembly for a vacuum cleaner comprising a generally cylindrical rigid plastic tube for insertion within the male end of the wand. The tube has locking tabs corresponding to through slots in the wand wall for securing the seal within the wall. An exterior flange located on the tube forms a shoulder which abuts the end of the wand tube to present a substantially flush exterior surface where the plastic meets the wand. A resilient plastic sealing member is secured by a securing portion or tab within a peripheral interior groove of a corresponding shape within the plastic tube. The sealing member projects both axially and radially outwardly from the plastic tube so that the seal assembly presents a flexible seal of slightly larger diameter than the male wand end to the female wand end portion when the portions are assembled. A ga between the flexible sealing member and the plastic tube remains to allow displacement of the sealing member when inserted and removed from the female wand portion. A rounded exterior corner on the distal end of the sealing member provides ease of insertion of the wand seal assembly within the female wand portion.

Further features and advantages of the invention will readily be apparent from the specification and from the drawings.

DESCRIPTION OF THE INVENTION

Figure 1:
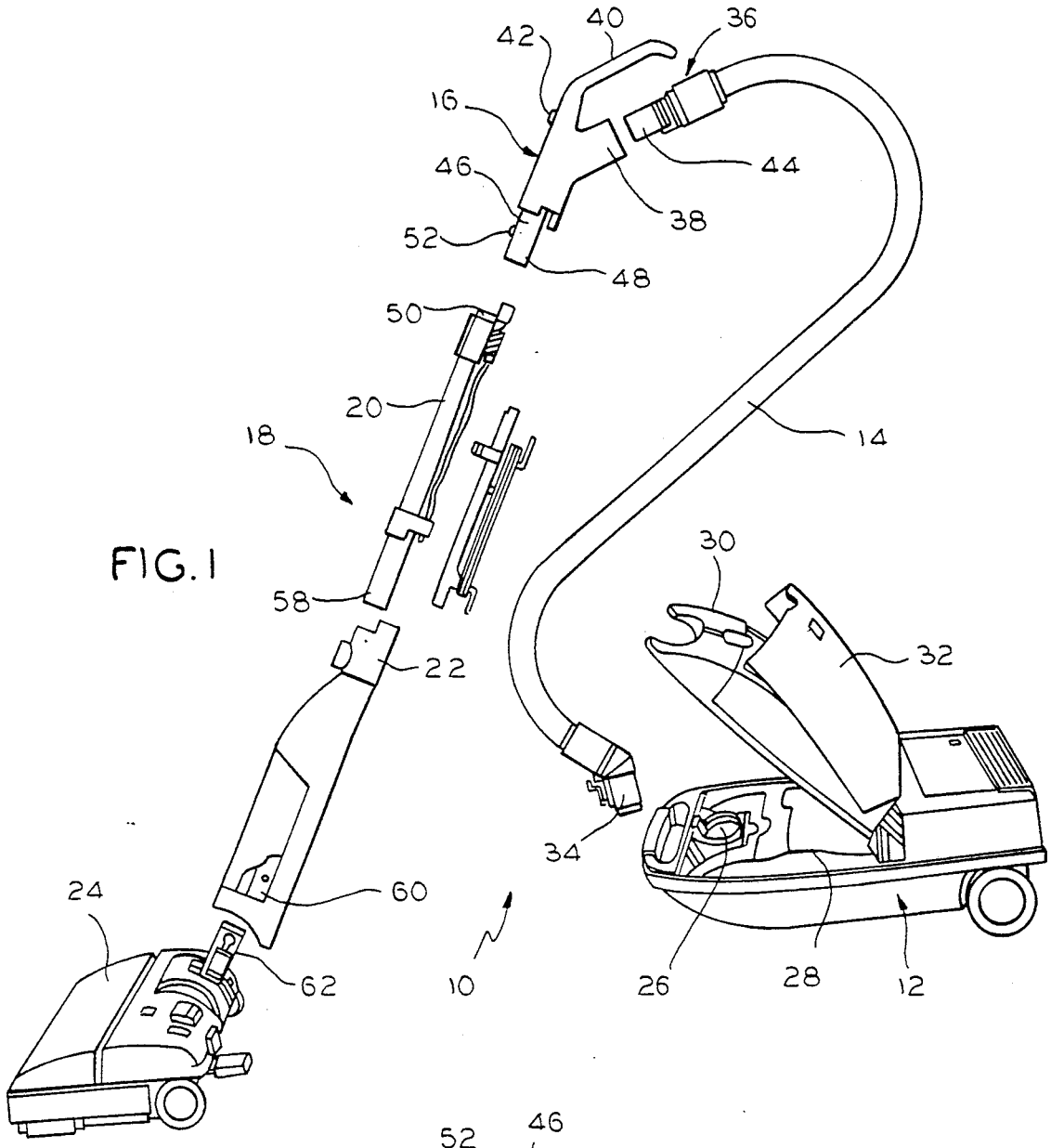
FIG. 1 is a partially exploded perspective view of a vacuum cleaner including the wand seal assembly according to the invention.

Referring to FIG. 1, a vacuum cleaner 10 including the wand seal assembly according to the invention is illustrated. The vacuum cleaner 10 comprises a canister-type vacuum cleaner. Although the description herein relates to such a vacuum cleaner, the wand seal assembly according to the invention could be used in connection with other types of vacuum cleaners including telescopic connections, as is obvious to those skilled in the art.

The vacuum cleaner 10 comprises a plurality of subassemblies which can be readily assembled by a user thereof. The vacuum cleaner 10 can then be easily broken down, if necessary, for storage or shipment.

The vacuum cleaner 10 includes a canister housing 12 connected through a hose 14 to a handle assembly 16. The handle assembly 16 is connected through a wand assembly 18, comprising a tubular wand portion 20 and a dust cup assembly 22, to a floor engaging nozzle 24.

Although not shown, the canister 12 includes a motor which develops vacuum pressure at an opening 26 to draw dust and debris into a dust bag 28, as is well known. The canister 12 includes a canister hood assembly 30 for mounting attachments, and a cover 32 for enclosing such attachments.

The hose 14 includes a first coupling element 34 at a proximate end for attaching to the canister 12 at the vacuum opening 26. At its opposite, distal end, the hose 14 includes a second coupling element 36 having a suction control for connection to a hose quick release element 38 on the handle assembly 16. The handle assembly 16 also includes a handle portion 40 having an on/-off switch 42 used to energize and deenergize the vacuum cleaner 10. To effect energization of the motor in the canister 12, the on/off switch 42 is connected to the canister 12 utilizing electrical conductors helically wound in the cover for the hose 14, and connected through suitable connector elements at the hose coupling members 34 and 36.

The hose second coupling element 36 comprises a molded rigid plastic male end 44 received in an enlarged opening (not shown) in the handle assembly quick release element 38, which defines a female opening.

Figure 2:
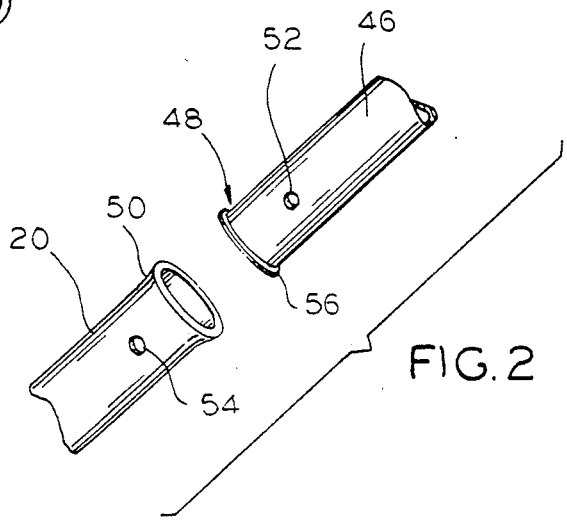
FIG. 2 is a cut-away exploded perspective view illustrating connection between telescoping members of the vacuum cleaner wand assembly.

The handle assembly 16 includes an outwardly extending metal tube 46 in communication with the quick release element 38. The tube 46 includes a swaged male end 48 receivable in an expanded female end 50 of the wand tube 20. With reference also to FIG. 2, the tube male end 48 includes a quick release element 52 receivable in an aperture 54 in the wand tube 20 for interlocking the tubes 46 and 20. In order to provide improved sealing between the male end 48 and female end 50, a wand seal assembly 56 is received in the tube male end 48, as discussed below.

A lower male end 58 of the tube 20 is telescopically received in the dust cup assembly 22. Although not shown, a seal similar to the seal 56, see FIG. 2, could be provided in the tube male end 58. The dust cup assembly 22 includes a longitudinally extending tube, part of which is illustrated at 60. The tube 60 receives a swivel coupler 62 on the floor nozzle 24.

With reference to FIGS. 3–6, the wand male end 48, including the seal assembly 56, is illustrated and described in greater detail hereinbelow.

The wand seal assembly 56 is of two-piece construction including a fastening member 64 and a sealing member 66. The fastening member 64 comprises a generally cylindrical rigid plastic tube 6 for insertion within the wand male end 48. The tube 68 includes opposite, radially outwardly extending locking tabs 70, partially surrounded by U-shaped openings 72, corresponding to through slots 74 in a wall 76 of the wand 46 securing the seal assembly 56 within the wand 46. Specifically, the seal assembly tube 68 is slidably inserted in the wand male end 48. The U-shaped opening 72 permits inward flexible movement of the locking tabs 70 as they abut the wall 76. Upon full insertion, the tabs 70 register in the openings 74.

The fastening member includes an inner groove 77 connecting a flange 78. The flange extends radially outwardly forming a shoulder 80 which abuts the end of the wall 76 upon full insertion. The outer diameter of the flange 78 is substantially identical to the outer diameter at the end of the wall 76 to provide a substantially flush exterior surface where the fastening member 64 meets the wand male end 48.

Figure 3:
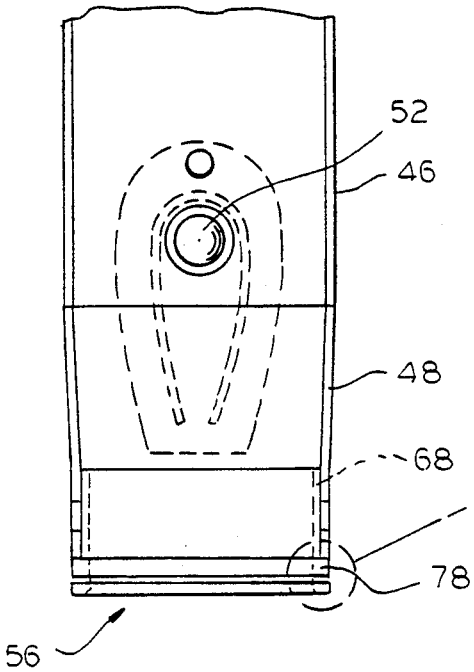
FIG. 3 is a side view illustrating the wand tubular male end including the seal according to the invention.
Figure 3A:
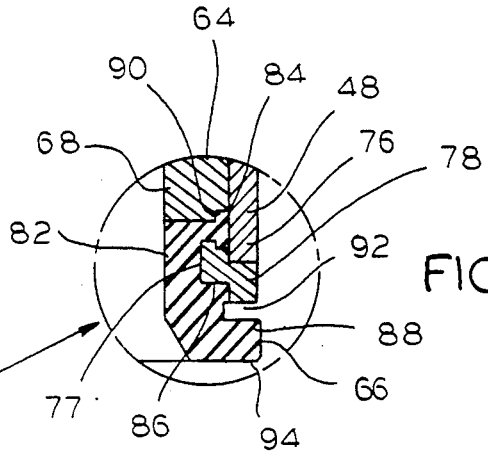
FIG. 3*a* is an enlarged detail view of the connection between the wand seal and the wand taken from FIG. 3.
Figure 4:
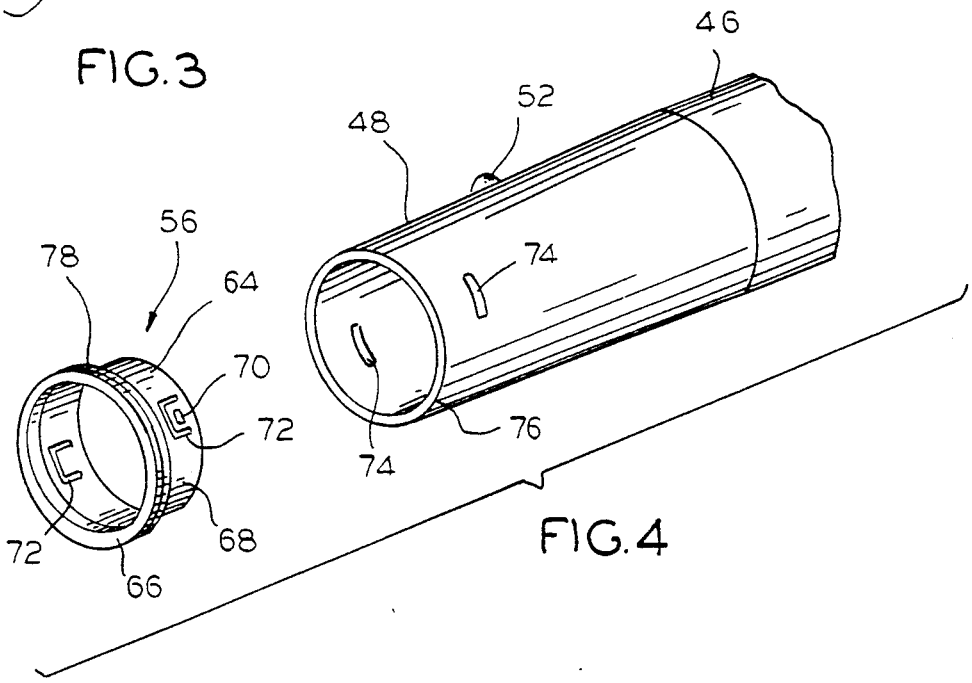
FIG. 4 is an exploded view illustrating the connection of the wand seal assembly in the male wand end portion.
Figure 5:
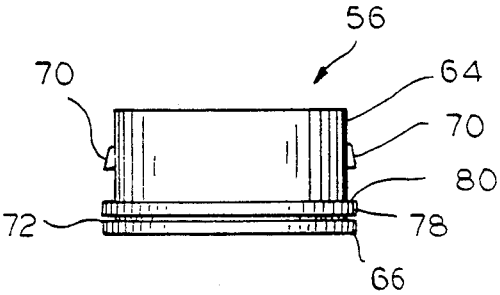
FIG. 5 is a side view of the wand seal assembly.
Figure 6:
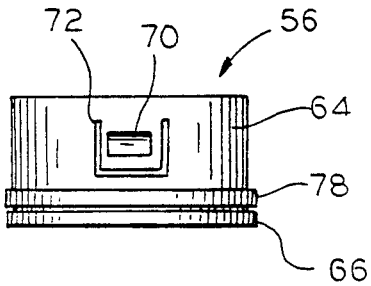
FIG. 6 is an alternative side view of the wand seal assembly taken 90° from the view of FIG. 5.

The sealing member 66 is of significantly less durometer, i.e., it is more flexible, than that of the fastening member 64. The sealing member 66 may be formed of, for example, a soft vinyl material. With specific reference to FIG. 3*a*, the sealing member 66 includes a relatively short cylindrical portion 82 having a plurality of inner end radially outwardly extending locking tabs 84, a middle flange 86, and an outer flange 88. The locking tabs 84 are received within inner peripheral openings 90 in the fastening member groove 77 for securing the sealing member 66 to the fastening member 64. The middle flange 78 abuts the outer wall of the groove 77 and the inside wall of the fastening member flange 78. A gap 92 is provided between the outer flange 88 and the middle flange 82, and thus also the fastening member flange 78.

The outer diameter of the outer flange 88 is slightly larger than the outer diameter of the wand wall 76 at the outer end. The flange 88 includes a rounded exterior corner 94 to facilitate ease of insertion of the wand seal assembly 56 within the wand female end 50. The gap 92 allows displacement of the sealing member outer flange 88 when the wand male end 48 is inserted in the tube female end 50, see FIG. 2. Since the sealing member outer flange 88 extends both axially and radially outwardly from the wand male end 48, the seal assembly 56 presents a flexible seal of slightly larger diameter to the female wand end 50 when the portions are assembled. The seal also provides a positive feel as between assembled parts.

An additional advantage of the seal assembly 56 is that it permits use of the wand male end 48 as a cleaning tool while preventing chipping or marring of household surfaces. Specifically, the flexibility of the sealing member 88 does not cause damage as might be caused by contact from bare metal of the male wand end 48.

Thus, in accordance with the above-described invention, a seal assembly 56 for a vacuum cleaner 10 improves the sealing between the swaged male end 48 of the wand 46 and the expanded female end 50 of the wand tube 20. The seal assembly is of dual durometer which can be used on any telescoping arrangement and provides a positive feel and wand fitting.

The foregoing disclosure is illustrative of the broad inventive concepts comprehended by the invention.

We claim:

1. In a vacuum cleaner including a canister and a floor engaging portion coupled by a two-piece tubular element, one piece having a male end received in a female end of the other piece, a vacuum cleaner seal comprising:

a generally cylindrical plastic tube inserted within the male end of said one piece and having an exterior flange extending radially outwardly of the one piece to seal against the female end of the other piece; and means for securing said plastic tube within the one piece comprising a locking tab extending radially outward from said tube and registering in a receiving element in said one piece to provide positive securement therein.

2. In a vacuum cleaner including a canister and a floor engaging portion coupled by a two-piece tubular element, one piece having a male end received in a female end of the other piece, a vacuum cleaner seal comprising:

a generally cylindrical plastic tube inserted within the male end of said one piece and having an exterior flange extending radially outwardly of the one piece to seal against the female end of the other piece wherein said plastic tube is of two-piece construction, the first piece comprising a first cylindrical tube having a flange having an outer diameter substantially identical to an outer diameter of the male end and the second piece comprising a second cylindrical tube secured within the first cylindrical tube and including said exterior flange axially and radially outwardly of the first tube flange; and means for securing said plastic tube within the one piece.

3. The vacuum cleaner seal of claim 2 wherein said first piece is of rigid plastic construction.

4. The vacuum cleaner seal of claim 2 wherein said second piece is of flexible plastic construction.

5. The vacuum cleaner seal of claim 2 wherein said second cylindrical tube includes a radial tab received in an interior opening in said first cylindrical tube.

6. The vacuum cleaner seal of claim 2 wherein said first and second piece flanges are axially spaced to permit displacement of the second flange incident to insertion of the male end within the female end.

7. A wand seal assembly for providing a resilient seal between a male end of a first vacuum cleaner wand portion receivable in a female end of a second vacuum cleaner wand portion, comprising:

a tubular member having a proximal end receivable within the male end of said first wand portion, a distal end including a radially extending flange having a shoulder limiting travel of said proximal end within said male end, and retaining means for removably securing said tubular member within said male end; and a resilient sealing member extending axially from the distal end of said of said tubular member for sealingly engaging the female end of said second wand portion incident to insertion of said male end within said female end.

8. The wand seal assembly of claim 7 wherein said sealing member extends radially outwardly of the male end of said first wand portion for sealingly engaging the female end of said second wand portion incident to insertion of said male end within said female end.

9. The wand seal assembly of claim 7 wherein said tubular member is formed of a relatively hard plastic material and said sealing member is formed of a relatively soft vinyl material.

10. The wand seal assembly of claim 7 wherein said sealing member includes a radial tab received in an interior opening in said tubular element.

11. The wand seal assembly of claim 7 wherein said sealing member includes a flange axially spaced from said tubular member flange to permit displacement of the sealing member shoulder incident to insertion of the male end within the female end.

12. In a vacuum cleaner including a canister and a floor engaging portion coupled by a two-piece suction member, said suction member comprising a hose coupled to said canister and having a handle portion with a tubular male end, and a tubular wand coupled to said floor engaging portion with a female end receiving said tubular male end, a vacuum cleaner seal for providing a resilient seal between said male end and said female end, comprising:

a rigid plastic tubular member having a proximal end receivable within the male end of said handle portion, a distal end including a radially extending flange defining a shoulder limiting travel of said proximal end within said male end, and retaining means for removably securing said tubular member within said male end; and a resilient sealing member secured to said tubular element and having a flange extending axially from the distal end of said of said tubular member for sealingly engaging the female end of said wand incident to insertion of said male end within said female end.

13. The vacuum cleaner seal of claim 12 wherein said sealing member flange extends radially outwardly of the male end of said handle portion for sealingly engaging the female end of said wand portion incident to insertion of said male end within said female end.

14. The vacuum cleaner seal of claim 12 wherein said tubular member is formed of a relatively hard plastic material and said sealing member is formed of a relatively soft vinyl material.

15. The vacuum cleaner seal of claim 12 wherein said sealing member includes a radial tab received in an interior opening in said tubular element.

16. The vacuum cleaner seal of claim 12 wherein said sealing member flange is axially spaced from said tubular member flange to permit displacement of the sealing member flange incident to insertion of the male end within the female end.

17. The vacuum cleaner seal of claim 12 wherein said radially extending flange has an outer portion substantially flush with the outer wall of the male end of said handle portion.

18. The vacuum cleaner seal of claim 12 wherein said retaining means comprises locking tabs extending outwardly from said plastic tubular member receivable in openings in the male end of said handle portion.

19. The vacuum cleaner seal of claim 12 wherein said resilient sealing member flange includes an outer rounded edge portion to facilitate insertion of the male end in said female end.

* * * * *